US006302235B1

(12) United States Patent
Matherne

(10) Patent No.: US 6,302,235 B1
(45) Date of Patent: Oct. 16, 2001

(54) HIGH-PERFORMANCE MUFFLER

(76) Inventor: Carson J. Matherne, 118 Wade St., Pierre Part, LA (US) 70339

( * ) Notice: Subject to any disclaimer, the term of this patent is extended or adjusted under 35 U.S.C. 154(b) by 0 days.

(21) Appl. No.: 09/517,989

(22) Filed: Mar. 3, 2000

(51) Int. Cl.[7] ..... F01N 1/08
(52) U.S. Cl. ..... 181/268; 181/269; 181/275
(58) Field of Search ..... 181/255, 257, 181/264, 266, 268, 269, 272, 273, 275, 276, 282, 281

(56) References Cited

U.S. PATENT DOCUMENTS 700,785 * 5/1902 Kull ..... 181/268
3,016,972 * 1/1962 Dugas ..... 181/276
4,577,724 * 3/1986 Vizard ..... 181/268
4,579,195 * 4/1986 Nieri ..... 181/272
6,024,189 * 2/2000 Heuser ..... 181/264

* cited by examiner

*Primary Examiner*—Khanh Dang
(74) *Attorney, Agent, or Firm*—Reginald F. Roberts, Jr.

(57) ABSTRACT

A muffler for automotive vehicles. The muffler includes a passageway, an inlet at one end of the passageway, and a single outlet or dual outlets at the passageway's other end. The portion of the muffler connected to the inlet is substantially untapered. The portion of the passageway connected to the outlet or outlets tapers from wide to narrow away from the inlet and toward the outlet or outlets. This tapered geometry results in a very appreciable reduction of heat transmitted from the muffler back to the engine, increases engine performance, and produces a pleasant, deep sound while the engine is running.

3 Claims, 2 Drawing Sheets

HIGH-PERFORMANCE MUFFLER

BACKGROUND OF THE INVENTION

The present invention relates to an automotive vehicle. More particularly, the invention relates to a muffler for an automotive vehicle.

The geometry of prior-art mufflers is not conducive to reducing the amount of heat returned to the engine. The present invention, by utilizing novel geometry and baffle construction, minimizes heat returned to the engine, improves engine performance, and provides a muffler which emits a pleasant, deep sound.

SUMMARY OF THE INVENTION

In general, the present invention provides an improved, high-performance muffler for an automotive vehicle. The term "automotive vehicle" includes automobiles, trucks, vans, and in general all kinds of motorized vehicles.

A first embodiment of the muffler comprises a passageway having first and second ends, an inlet at the first end of the passageway, an outlet at the second end of the passageway, a substantially untapered first portion of the passageway connected to the inlet, a tapered second portion of the passageway connected to the outlet, and baffle means disposed between the first and second ends of the passageway. The second portion of the passageway tapers from wide to narrow in a direction away from the first end of the passageway toward the second end of the passageway.

A second embodiment of the muffler comprises a passageway having first and second ends, at least one inlet at the first end of the passageway, first and second outlets at the second end of the passageway, a substantially untapered first portion of the passageway connected to the inlet, tapered second and third portions of the passageway connected to the first and second outlets, respectively, and baffle means disposed between the first and second ends of the passageway. The second and third portions of the passageway taper from wide to narrow in a direction away from the first end and toward the second end of the passageway.

DETAILED DESCRIPTION OF THE INVENTION

Figure 1:
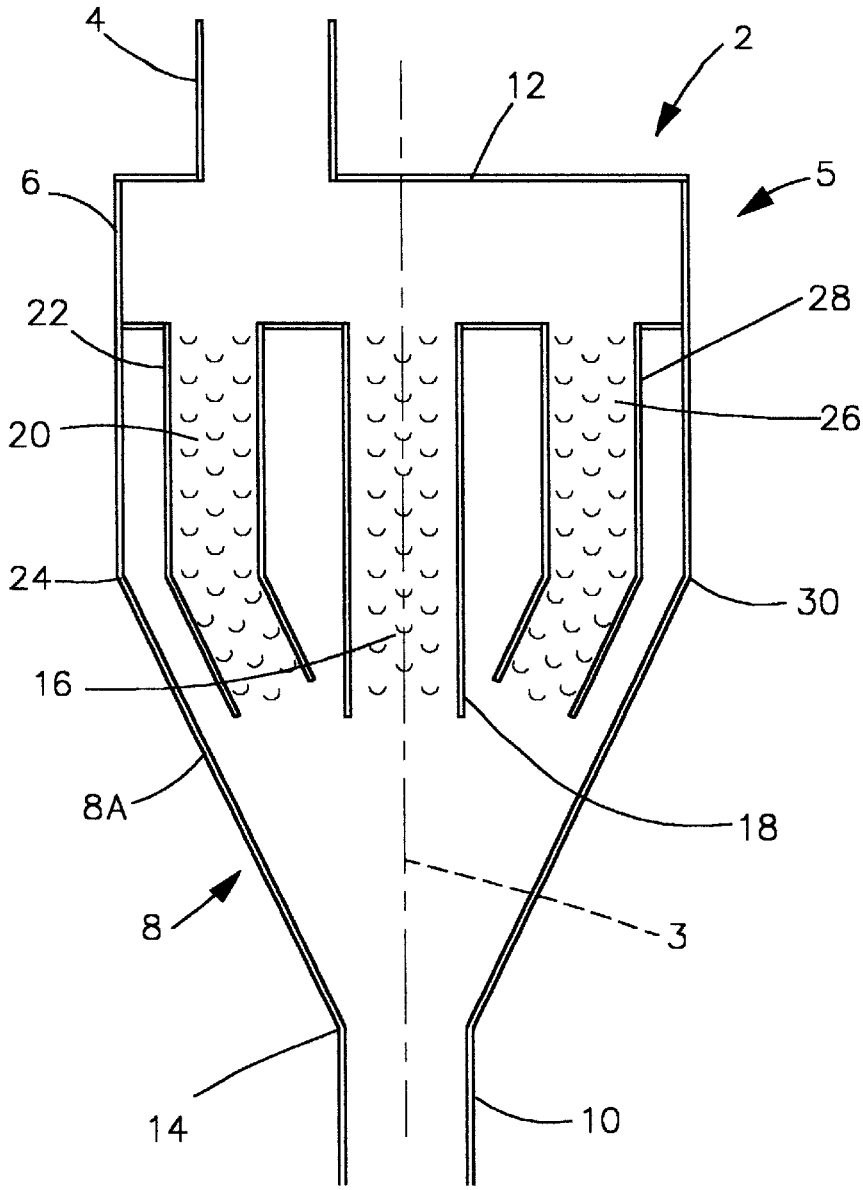
FIG. 1 is a schematic representation of a first embodiment of a muffler made in accordance with the principles of the present invention, with the top portion of the muffler cut away, as viewed from above.
Figure 2:
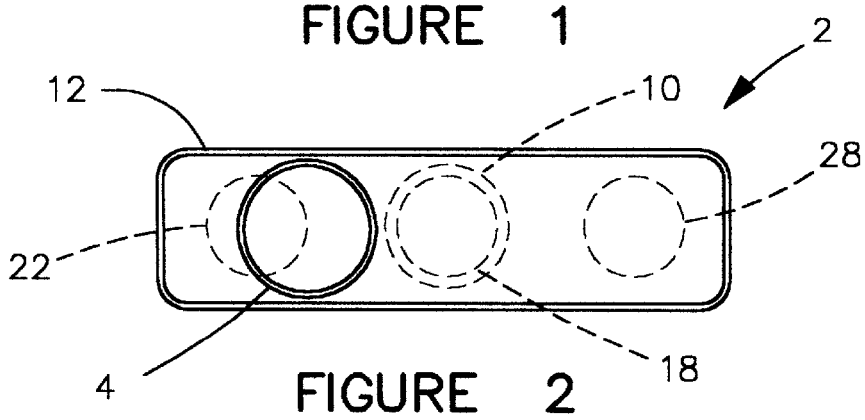
FIG. 2 is a schematic representation of the muffler shown in FIG. 1, as viewed from the inlet end of the muffler.

More specifically, reference is made to FIGS. 1 and 2, in which is shown a first embodiment of a muffler made in accordance with the principles of the present invention, and generally designated by the numeral 2.

The muffler 2 comprises a passageway 5 having a central longitudinal axis 3 and an inlet 4 which opens into a substantially untapered first portion 6 of the passageway 5. A second portion 8 includes a tapered portion 8*a* connecting the first portion 6 of the passageway 5 to an outlet 10. Preferred lengths of the first and second portions 6 and 8 of the passageway 5 are about six and ten inches, respectively.

Baffle means are disposed between first and second ends 12 and 14 of the passageway 5. The baffle means comprise a central channel 16 formed by a first tube 18, a first lateral channel 20 formed by a second tube 22 disposed near a first side 24 of the passageway 5, and a second lateral channel 26 formed by a third tube 28 disposed near a second side 30 of the passageway 5. The central channel 16 circumscribes the axis 3. The upper portions of the lateral channels 20 and 26 are substantially parallel to the axis 3, and the lower portions of the lateral channels 20 and 26 are substantially parallel to the first and second sides 24 and 30 of the second portion 8 of the passageway 5. The first, second, and third tubes 18, 22, and 28 extend from the first portion 6 into the second portion 8 of the passageway 5.

Preferably, the inlet 4 and outlet 10 are of approximately the same diameter, the first tube 18 is smaller than the inlet 4 and outlet 10, and the second and third tubes 22 and 28 are smaller than the first tube 18.

Preferred diameters of the inlet 4, outlet 10, first tube 18, and second and third tubes 22 and 28 are two and one-half to three inches, two and one-half to three inches, two inches, and one and three-quarter inches, respectively. The preferred length of the first, second and third tubes 18, 22 and 28 is about seven inches.

The entire muffler 2 is beneficially made of sixteen-gauge steel and painted with high-temperature aluminum paint. It is preferably about ten inches wide at its first end 12 and about three inches deep.

The combination of a tapered geometry and free-flowing baffling provides a muffler which significantly reduces the transmission of heat back to the engine, increases engine performance, and produces a pleasant, deep sound while the engine is operating.

Figure 3:
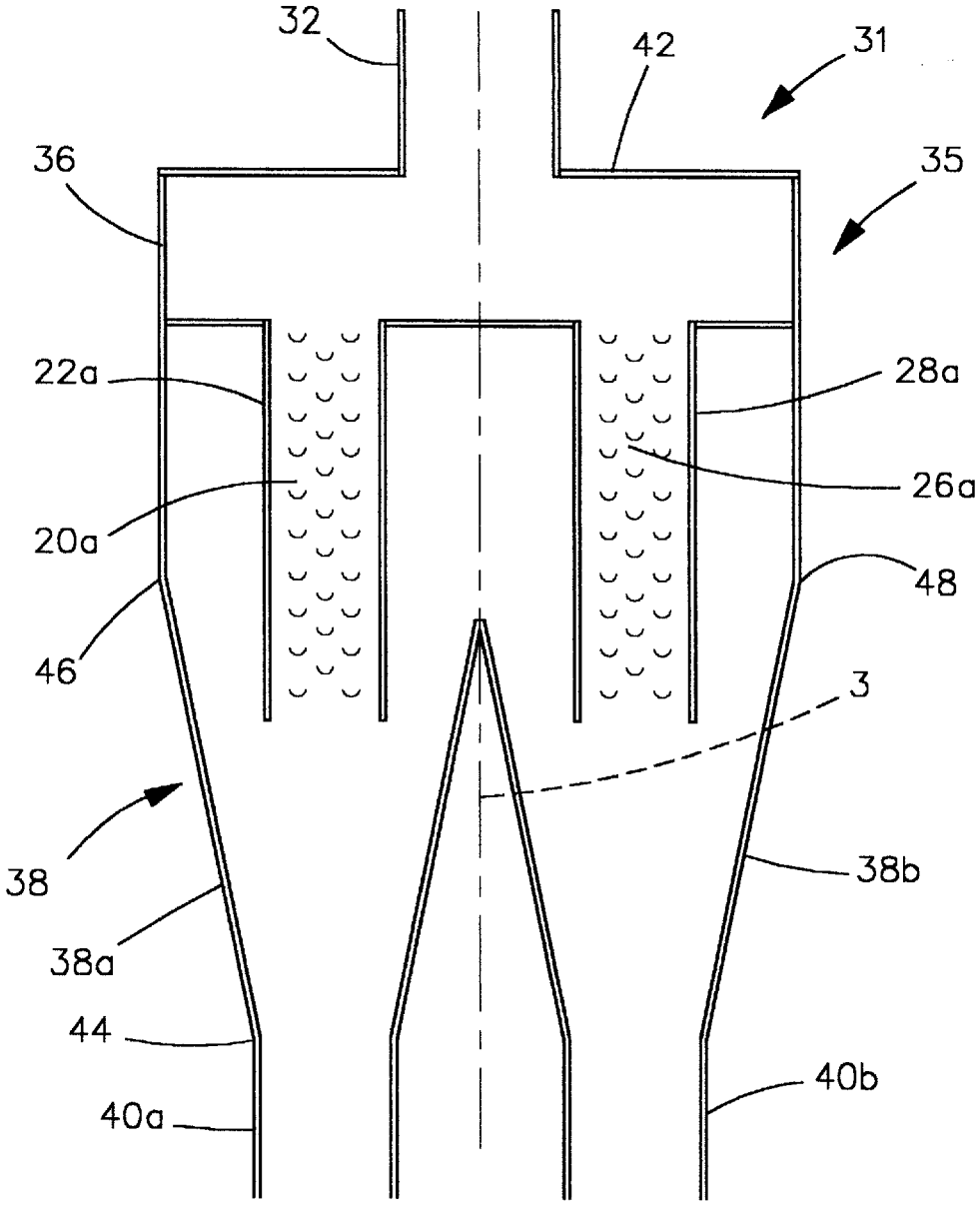
FIG. 3 is a schematic representation of a second embodiment of a muffler made in accordance with the principles of the present invention, with the top portion of the muffler cut away, as viewed from above.
Figure 4:
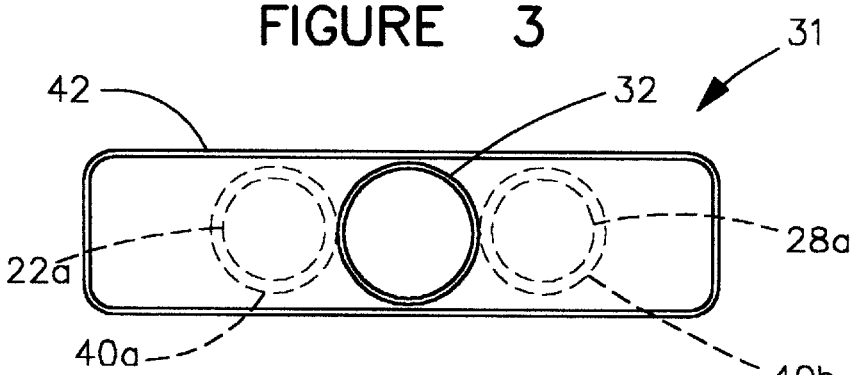
FIG. 4 is a schematic representation of the muffler shown in FIG. 3, as viewed from the inlet end of the muffler.

Reference is now made to FIGS. 3 and 4, in which is shown a second embodiment of a muffler, made in accordance with the principles of the present invention, and generally designated by the numeral 31.

The muffler 31 comprises a passageway 35 having a central longitudinal axis 3, and an inlet 32 which opens into a first substantially untapered portion 36 of the passageway 35. A second portion 38 of the passageway 35 includes first and second tapered portions 38*a* and 38*b* connecting the first portion 36 of the passageway 35 to first and second outlets 40*a* and 40*b*. Preferred lengths of the first and second portions 36 and 38 of the passageway 35 are about six and ten inches, respectively.

Baffle means similar to those in the muffler 2 are disposed between first and second ends 42 and 44 of the passageway 35. The baffle means comprise a first lateral channel 20*a* formed by a first tube 22*a* disposed near a first side 46 of the passageway 35, and a second lateral channel 26*a* formed by a second tube 28*a* disposed near a second side 48 of the passageway 35. The lateral channels 20*a* and 26*a* are substantially parallel to the axis 3. The first and second tubes 22*a* and 28*a* extend from the first portion 36 into the second portion 38 of the passageway 35.

Preferably, the inlet 32 and outlets 40*a*, 40*b* are of approximately the same diameter, and the first and second tubes 22*a* and 28*a* are smaller than the inlet 32 and outlets 40*a*, 40*b*.

Preferred diameters of the inlet 32, outlets 40*a*, 40*b*, and first and second tubes 22*a* and 28*a* are two and one-half to three inches, two and one-half to three inches, and two inches, respectively. The preferred length of the first and second tubes 22*a* and 28*a* is about seven inches.

The entire muffler 31 is beneficially made of sixteen-gauge steel and painted with high-temperature aluminum paint. It is preferably about ten inches wide at its first end 42 and abut three inches deep.

The combination of a tapered geometry and free-flowing baffling provides a muffler having the same advantages as the first embodiment shown in FIGS. 1 and 2; viz., a significant reduction of heat transmission to the engine, improved engine performance, and a pleasant, deep sound while the engine is operating.

While certain embodiments and details have been described to illustrate the present invention, it will be apparent to those skilled in the art that many modifications are possible without departing from the basic concept of the invention.

I claim:

1. A muffler for an automotive vehicle, comprising:

(a) a casing having two parallel planar spaced-apart longitudinal plates connected to one another by two parallel planar spaced-apart lateral plates, the longitudinal plates being parallel to one another, the lateral plates being parallel to one another, and the lateral plates being perpendicular to the longitudinal plates;

(b) a passageway, disposed within the casing, having first and second ends, an inlet at the first end of the passageway, an outlet at the second end of the passageway, a substantially untapered first portion of the passageway connected to the inlet, a tapered second portion of the passageway connected to the outlet, and baffle means disposed between the first and second ends of the passageway; the second portion of the passageway tapering from wide to narrow in a direction away from the first end of the passageway and toward the second end of the passageway.

2. A muffler for an automotive vehicle, comprising: a passageway having first and second ends, an inlet at the first end of the passageway, an outlet at the second end of the passageway, a substantially untapered first portion of the passageway connected to the inlet, a tapered second portion of the passageway connected to the outlet, and baffle means disposed between the first and second ends of the passageway; the second portion of the passageway tapering from wide to narrow in a direction away from the first end of the passageway toward the second end of the passageway; the baffle means comprising a central longitudinal channel circumscribing a central longitudinal axis of the passageway, a first lateral channel near and substantially parallel to a first side of the passageway, and a second lateral channel near and substantially parallel to a second side of the passageway.

3. A muffler for an automotive vehicle, comprising:

(a) a passageway having first and second ends, an inlet at the first end of the passageway, an outlet at the second end of the passageway, a substantially untapered first portion of the passageway connected to the inlet, a tapered second portion of the passageway connected to the outlet, and baffle means disposed between the first and second ends of the passageway; the second portion of the passageway tapering from wide to narrow in a direction away from the first end of the passageway toward the second end of the passageway; the baffle means comprising (b) a central channel circumscribing a central longitudinal axis of the passageway;

(c) a first lateral channel near and substantially parallel to a first side of the passageway; and (d) a second lateral channel near and substantially parallel to a second side of the passageway; wherein (e) the central channel is formed by a centrally-disposed tubular member extending from the first portion into the second portion of the passageway;

(f) the first lateral channel is formed by a first laterally-disposed tubular member extending from the first portion into the second portion of the passageway; and (g) the second lateral channel is formed by a second laterally-disposed tubular member extending from the first portion into the second portion of the passageway.

* * * * *